United States Patent [19]

Sugihara et al.

[11] 4,306,297

[45] Dec. 15, 1981

[54] APPARATUS FOR MEASURING THE VECTOR VOLTAGE RATIO OF TWO A.C. SIGNALS

[75] Inventors: Noriyuki Sugihara, Hachioojishi, Japan; Takashi Yoshida, Stanford, Calif.

[73] Assignee: Hewlett-Packard Company, Palo Alto, Calif.

[21] Appl. No.: 115,179

[22] Filed: Jan. 25, 1980

[30] Foreign Application Priority Data

Jan. 30, 1979 [JP] Japan ..... 54-9358

[51] Int. Cl.[3] ..... G06G 7/16

[52] U.S. Cl. ..... 364/850; 328/133; 328/161; 364/483

[58] Field of Search ..... 364/850, 482, 483; 324/140 D, 119, 99 D, 78 R, 78 E, 83 Q, 83 FE; 328/26, 32, 133, 161; 307/229, 230

[56] References Cited

U.S. PATENT DOCUMENTS

| | | | |
|---|---|---|---|
| 3,204,185 | 8/1965 | Robinson | 328/161 X |
| 3,321,614 | 5/1967 | Levadi | 364/850 X |
| 3,363,188 | 1/1968 | Gardere | 328/161 X |
| 3,456,190 | 7/1969 | Renner | 364/850 X |
| 3,652,930 | 3/1972 | Sugiyama et al. | 364/482 X |

*Primary Examiner*—Joseph F. Ruggiero
*Attorney, Agent, or Firm*—John A. Frazzini

[57] ABSTRACT

An apparatus is disclosed for determining the vector voltage ratio of two a.c. input signals. A synchronous rectifying circuit, a phase shifter and a voltmeter are employed to detect the in-phase and orthogonal components of the input signals relative to a reference signal. A calculation section determines the vector voltage ratio from the values of these components.

4 Claims, 4 Drawing Figures

(R: RELAXATION TIME (PAUSE))

APPARATUS FOR MEASURING THE VECTOR VOLTAGE RATIO OF TWO A.C. SIGNALS

BACKGROUND OF THE INVENTION

The present invention concerns an apparatus for measuring the vector voltage ratio of two a.c. signals having different phase and amplitude. In prior art methods for measuring the vector voltage ratio of two input signals, the conventional method involved detecting by synchronous rectification the in-phase component and the orthogonal component of a second input signal relative to a first input signal. In these methods the in-phase component is determined by employing the first input signal to synchronously rectify the second input signal. The orthogonal component is determined by employing the first input signal shifted in phase by $\pi/2$ to synchronously rectify the second input signal.

When precisely measuring the vector voltage ratio by the above method, it is necessary to eliminate the total phase error of the input signals at the synchronous rectifier including the phase error due to the signal paths. If such phase errors are not eliminated, the in-phase component and orthogonal component are not precisely detected. In order to eliminate the effect of phase error of the synchronous rectifier, an apparatus for measurement of the vector voltage ratio combining a synchronous rectifying circuit (e.g. a modulator) and an analog circuit is shown in Japanese patent number SHOWA 53-26823(KOUKOKU) entitled "Apparatus for Measurement of Vector Voltage Ratio". In order to eliminate the offset phase error which is inherent in the synchronous rectifying circuit as well as the phase error due to the two signal paths to the synchronous rectifying circuit, the synchronous rectifying circuit itself is improved. (See, for example, Japanese UTILITY MODEL Appl. No. SHOWA 50-79922 entitled "Apparatus for Compensation of Phase Error of Phase Detector".) But these conventional techniques require complicated analog techniques.

SUMMARY OF THE INVENTION

In accordance with the illustrated preferred embodiment an apparatus for measuring the vector voltage ratio is provided which digitally removes the measurement error caused by the phase errors inherent in a synchronous rectifying circuit and the signal paths to the synchronous rectifying circuit. The apparatus of this invention includes: a switching circuit to selectively enter one of two a.c. input signals to a first input terminal of a synchronous rectifying circuit; a phase shifting circuit to shift the phase of one a.c. input signal and to introduce it to a second input terminal of the synchronous rectifying circuit; a control circuit to select the input a.c. signal entered by the switching circuit and the phase shift of the phase shifting circuit; a voltage meter to determine the output voltage of the synchronous rectifying circuit; and a calculating section to calculate the vector voltage ratio from the output voltage of the synchronous rectifying circuit.

DESCRIPTION OF THE PREFERRED EMBODIMENT

Figure 1:
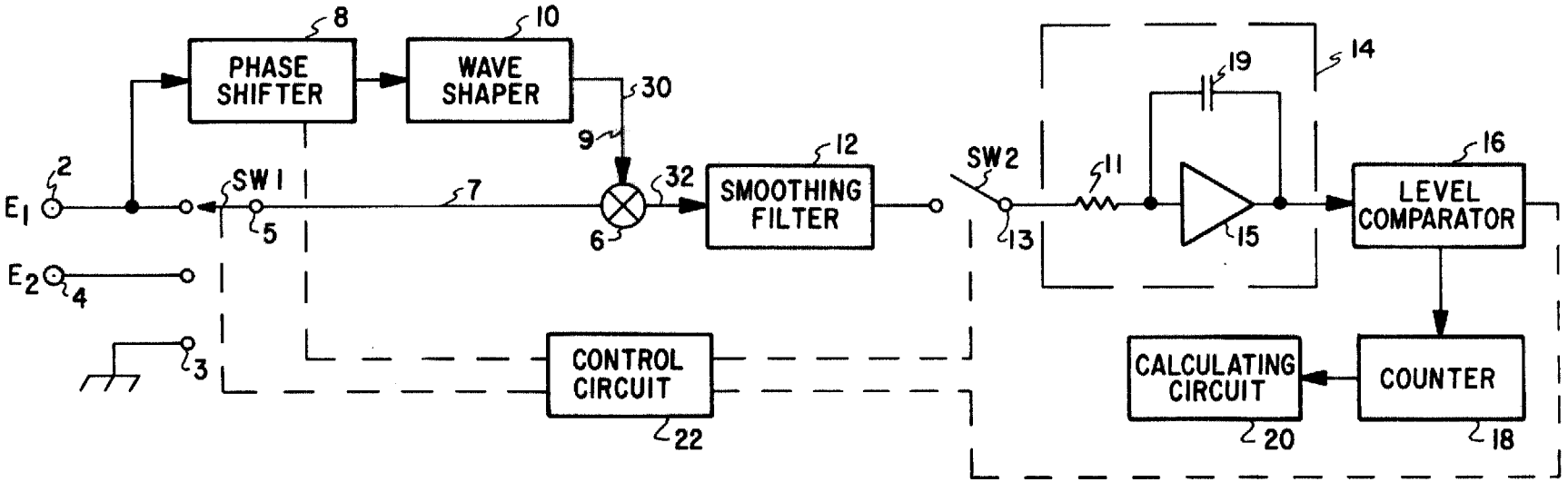
FIG. 1 is a block diagram of a preferred embodiment of the apparatus for measuring the vector voltage ratio of two a.c. signals.

A first input signal E1, a second input signal E2, and a ground level voltage are introduced respectively to a first input terminal 2 to a second input terminal 4 and to a ground input terminal 3. A first switch 5 selectively introduces input signal E1, input signal E2 or the ground level voltage to a first input terminal 7 of a modulator 6. Modulator 6 can also be chosen to be a multiplier. The first input signal E1 is also introduced to a second input terminal 9 of modulator 6 through a phase shifter 8 and a wave shaper 10. Phase shifter 8 herein shifts the phase of the first input signal E1 by 0, $\pi/2$, or $\pi$ radians and wave shaper 10 transforms the signal sent from phase shifter 8 into a square wave having a high and a low voltage level. The output signal of modulator 6 is transmitted to a smoothing filter 12, to produce a d.c. output signal which is introduced through a second switch 13 to an input terminal 11 of an integrator 14. As illustrated in this embodiment, integrator 14 includes an operational amplifier 15, an input resistor 17 and a feedback capacitor 19. A level comparator 16 and a counter 18 are connected with the output terminal of integrator 14 to form the dual-slope voltmeter. A calculating circuit 20 is coupled to counter 18 to perform fixed calculations according to values of counter 18. In addition, a control circuit 22 is coupled to phase shifter 8 and switches 5 and 13 to control switches 5 and 13 and to control the amount of phase shift of phase shifter 8.

Figure 2:
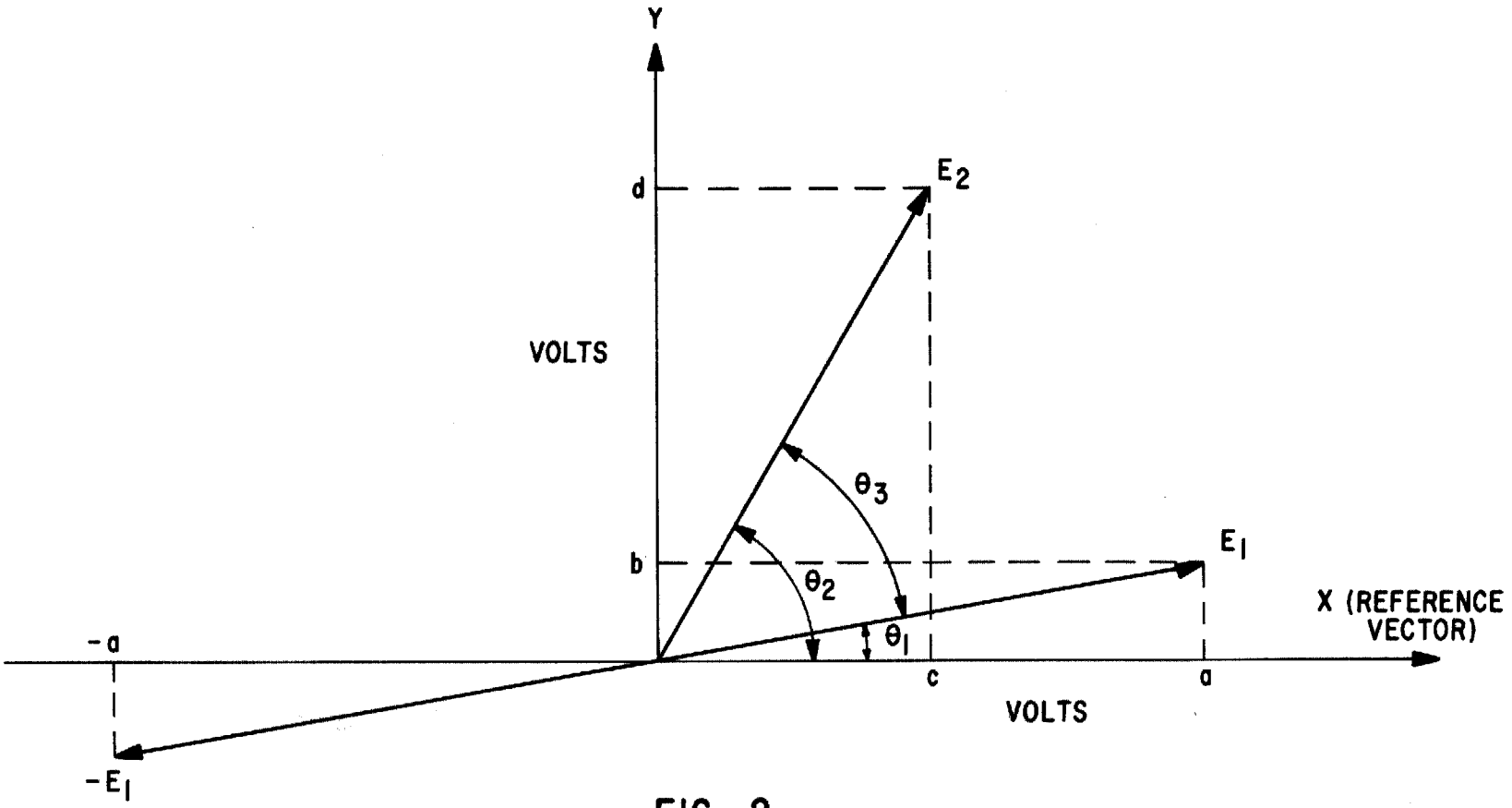
FIG. 2 is a vector diagram showing the phase relation between the first input signal E1, the second input signal E2, and the reference signal X.

FIG. 2 is a vector diagram (i.e. a phasor diagram) showing the phase relation between the first input signal E1 and the second input signal E2 illustrated in FIG. 1. In this diagram, the phase difference between a reference vector X and first input signal E1 is $\theta_1$, and the phase difference between reference vector X and second input signal E2 is $\theta_2$. The vector components of input signals E1 and E2 which are in phase with reference vector X are a and c respectively. The components of input signals E1 and E2 which are orthogonal to reference vector X are b and d respectively.

The ratios B=b/a, C=c/a, and D=d/a will be used in calculating the vector ratio of input signals E1 and E2. The real part $\alpha$ and the imaginary part $\beta$ of the vector voltage ratio $E2/E1=\alpha+j\beta$ are $\alpha=(C+BD)/(1+B^2)$ and $\beta=(D-CB)/(1+B^2)$.

Proof $$\begin{aligned}\theta_3 &= \theta_2 - \theta_1\\ &= \tan^{-1}(d/c) - \tan^{-1}(b/a)\\ &= \tan^{-1}\{(d/a)/(c/a) - \tan^{-1}(b/a)\}\\ &= \tan^{-1}(D/C) - \tan^{-1}(B)\\ &= \tan^{-1}\{(D/C - B)/(1 + DB/C)\}\end{aligned}$$

-continued $$= \tan^{-1}\{(D - CB)/(C + DB)\}$$

Define P=(D−CB)/(C+DB), then:

$$\theta_3 = \cos^{-1}\frac{1}{\sqrt{1+P^2}} = \sin^{-1}\frac{P}{\sqrt{1+P^2}}$$

and $$|E1| = \sqrt{a^2 + b^2}$$

$$= \left(\sqrt{(a^2 + b^2)/a^2}\right) * a$$

$$= a\sqrt{1 + B^2}$$

Similarly, $$|E2| = a\sqrt{C^2 + D^2}$$

Because $$\frac{|E2|}{|E1|} = \sqrt{\frac{C^2 + D^2}{1 + B^2}} \quad \text{and}$$

$$\frac{E2}{E1} = \alpha + j\beta = \frac{|E2|}{|E1|}\cos\theta_3 + j\frac{|E2|}{|E1|}\sin\theta_3$$

The values of $\alpha$ and $\beta$ are:

$$\alpha = \sqrt{\frac{C^2 + D^2}{1 + B^2}} \cdot \sqrt{\frac{1}{1 + P^2}} = \frac{C + BD}{1 + B^2}$$

and $$\beta = \sqrt{\frac{C^2 + D^2}{1 + B^2}} \cdot \sqrt{\frac{P}{1 + P^2}} = \frac{D - CB}{1 + B^2}$$

Therefore the vector voltage ratio can be determined in accordance with the above equations for $\alpha$ and $\beta$, from the detected values of a, b, c and d.

Figure 3:
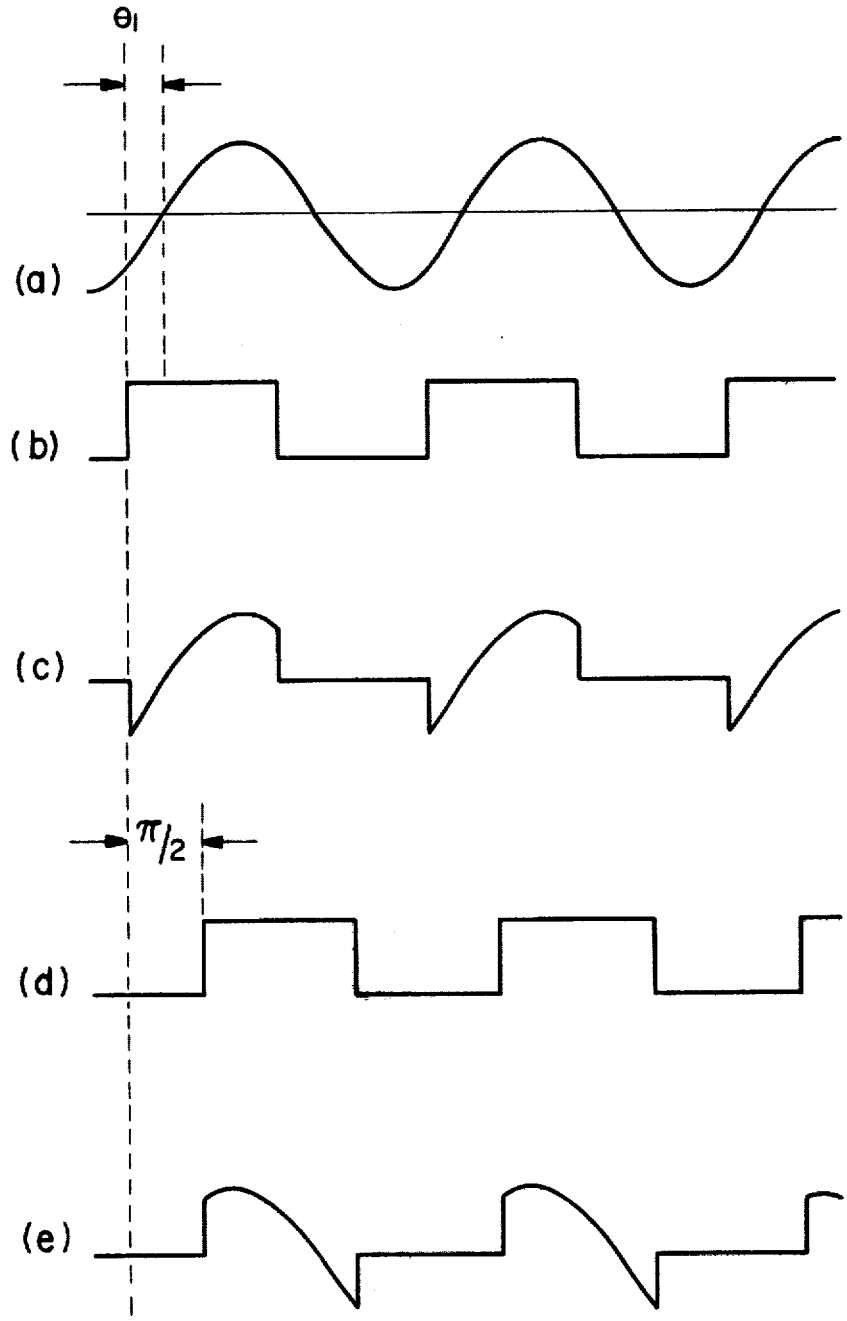
FIG. 3 shows the relation of the input and output signals of the modulator employed in the preferred embodiment shown in FIG. 1.

FIG. 3 illustrates the operation of modulator 6 shown in FIG. 1. In FIG. 3, $\theta_1$ is the phase difference between the output square wave 30 of wave shaper 10 and the first input signal E1 when the amount of phase shift of phase shifter 8 is zero. For an ideal modulator 6, the phase difference $\theta_1$ is considered to be caused by the signal path (including wave shaper 10) between the first input terminal 2 and modulator 6, and is a small but inherent phase error. Therefore, if the phase shift amount of phase shifter 8 is $\pi/2$, the phase difference $(\pi/2+\theta_1)$ will appear between the output square wave 30 and the first input signal E1.

FIG. 3(*a*) shows the first input signal E1, and FIG. 3(*b*) shows the output square wave 30 produced by wave shaper 10 when the amount of phase shift of phase shifter 8 is equal to zero. $\theta_1$ is the phase difference between the signals shown in FIGS. 3(*a*) and 3(*b*). When switch 5 of FIG. 1 is connected with input terminal 2 and when the first input signal E1 shown in FIG. 3(*a*) and the output square wave 30 shown in FIG. 3(*b*) are introduced, modulator 6 generates a detected signal 32 shown in FIG. 3(*c*). In other words, the detected signal 32 shown in FIG. 3(*c*) represents the component of the first input signal in phase with the output signal 30 of FIG. 3(*b*). In terms of the vector diagram drawn in FIG. 2, the output square wave 30 shown in FIG. 3(*b*) and the detected signal 32 shown in FIG. 3(*c*) correspond respectively to vector X and to the value a of the in-phase component of input signal E1 relative to reference vector X.

FIG. 3(*d*) shows square wave 30 when the amount of phase shift of phase shifter 10 is $\pi/2$, and FIG. 3(*e*) shows the detected signal 32 of modulator 6 when the first input signal E1 of FIG. 3(*a*) is entered by switch 5. In terms of the vector diagram illustrated in FIG. 2, the output square wave 30 shown in FIG. 3(*d*) and the detected signal 32 shown in FIG. 3(*e*) correspond, respectively, to the right-angled reference vector Y and to the value b of the orthogonal component of input signal E1 relative to reference vector X.

It is possible to analyze similarly the second input signal E2 illustrated in FIG. 2. That is, the value c of the in-phase component of E2 with respect to the reference vector X is detected by:

(1) connecting the first switch 5 with the second input terminal 4; and (2) selecting the phase shift amount of phase shifter 8 to be zero.

The value d of the orthogonal component of E2 with respect to the reference vector X is detected by:

(1) connecting the first switch 5 with the second input terminal 4; and (2) selecting the phase shift amount of phase shifter 8 to be $\pi/2$.

The component "−a" is detected by:

(1) connecting the first switch 5 with the first input terminal 2; and (2) selecting the phase shift amount of phase shifter 8 to be $\pi$.

That is, the signal 32, generated by modulator 6, is the negative of the signal shown in FIG. 3(*c*).

The a.c. signal 32 generated by modulator 6 is smoothed by the filter 12 to produce a d.c. voltage for application to integrator 14. As explained above, the components of the first input signal E1 and the second input signal E2 which are in-phase (a, c), orthogonal (b, d), and reverse-phase (−a) with respect to reference vector X are generated by appropriate control of the first switch 5 and phase shifter 8. Such control is implemented by control circuit 22.

The sequence of operations to generate the vector voltage ratio will now be described, using the equations for $\alpha$ and $\beta$ in terms of B, C, and D, the equation for E2/D1 in terms of $\alpha$ and $\beta$, and the apparatus illustrated in FIG. 1.

Figure 4:
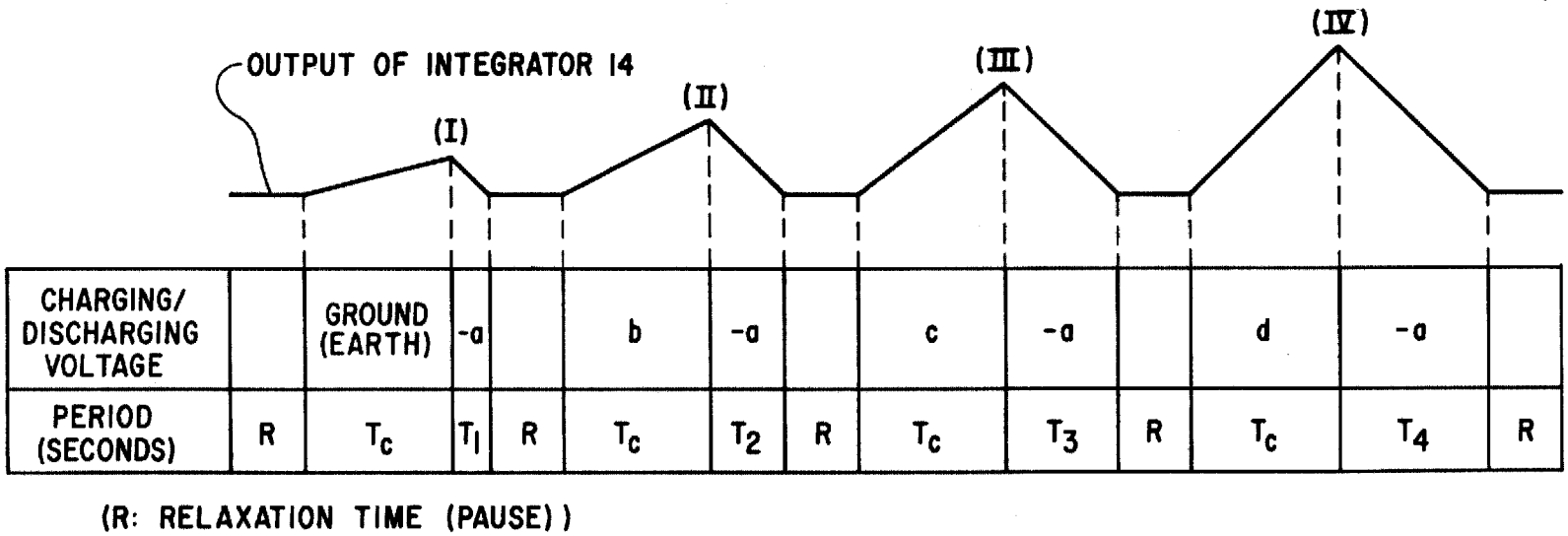
FIG. 4 shows a time plot of the output voltage of the integrator employed in the preferred embodiment shown in FIG. 1.

FIG. 4 is a sequential diagram of the steps involved in generating the vector voltage ratio. Each of the steps illustrated (Steps (I) to (IV)) includes a charging and a discharging step. The saw-tooth wave illustrated in FIG. 4 represents the output voltage of integrator 14. Operation of every step will be explained below, by reference to FIG. 1. Although the output voltage of integrator 14 rises or falls depending on the polarity of the input signal, it is assumed to rise in this illustration.

Step (I) (Calculation of Offset/a) Step I consists of the following operations:

(1) connecting the first switch 5 to the ground;

(2) selecting the amount of phase shift of phase shifter 8 to be zero;

(3) turning on the second switch 13 and integrating for a constant selected time of Tc seconds. (The value of Tc is unimportant—it need only be constant for each of the steps.);

(4) connecting the first switch 5 to the first input terminal 2 and selecting the amount of phase shift of phase shifter 8 to be $\pi$ to integrate (i.e. to discharge) by "−a" volts; and (5) when the output voltage of integrator 14 falls to a level fixed by a comparator 16, turning off the second switch 13. (This time is denoted as T1).

Step I is performed to compensate for offset error of the integrator 14 and therefore is not needed when the operation of the integrator 14 is ideal. The value of the offset divided by the value a of the in-phase component of E1 is equal to T1/Tc. The value of T1/Tc is determined by calculating circuit 20 from values of counter 18.

Step (II) (Calculation of B) Step II consists of the following operations:

(1) connecting the first switch 5 with the first input terminal 2;

(2) selecting the amount of phase shift of phase shifter 8 to be $\pi/2$;

(3) turning on the second switch 13 and integrating for a fixed time of Tc seconds (i.e. the right-angled component b of the first input signal E1 is integrated for Tc seconds);

(4) selecting the amount of phase shift of phase shifter 8 to be $\pi$ (note that the first switch 5 remains connected to input terminal 2 during this integration of "−a" volts.); and (5) when the output voltage of integrator 14 falls to the level fixed by comparator 16, turning off the second switch 13. (This time interval is denoted as T2).

If an ideal integrator with zero offset is used, B is calculated as B=b/a=T2/Tc. When the offset error of integrator 14 is detected in Step (I), B is calculated as B=(T2/Tc)−(T1/Tc).

Step (III) (Calculation of C) Step III consists of the following operations:

(1) connecting the first switch 5 with the second input terminal 4;

(2) selecting the amount of phase shift of phase shifter 8 to be 0;

(3) turning on the second switch 13 and integrating for a fixed time of Tc seconds (i.e. the in-phase component C of the second input signal E2 is integrated for Tc seconds);

(4) connecting the first switch 5 with the first input terminal 2 and selecting the amount of phase shift of phase shifter 8 to be $\pi$ to integrate (i.e. to discharge) by "−a" volts; and (5) when the output voltage of integrator 14 falls to a level fixed by comparator 16, turning off the second switch 13. (This time interval is denoted as T3).

If an ideal integrator with zero offset is used, C is calculated as C=c/a=T3/Tc. When the offset error of integrator 14 is detected in Step (I), C is calculated as C=(T3/Tc)−(T1/Tc).

Step (IV) (Calculation of D) Step IV consists of the following operations:

(1) connecting the first switch 5 with the second input terminal 4;

(2) selecting the amount of phase shift of phase shifter 8 to be $\pi/2$;

(3) turning on the second switch 13 and integrating for a fixed time of Tc seconds (i.e. the right-angled component d of the second input signal E2 is integrated for Tc seconds);

(4) connecting the first switch 5 with the first input terminal 2 and selecting the amount of phase shift of phase shifter 8 to be $\pi$ to integrate (i.e. to discharge) by "−a" volts; and (5) when the output voltage of integrator 14 falls to a level fixed by comparator 16, turning off the second switch 13. (This time interval is denoted by T4).

If an ideal integrator with zero offset is used, C is calculated as C=c/a=T3/Tc. When the offset error of integrator 14 is detected in Step (I), D is calculated as C=(T4/Tc)−(T1/Tc).

After B, C, and D are determined by the Steps (I) to (IV), the vector voltage ratio is calculated by calculating circuit 20 by the use of the equations cited above for E2/E1 in terms of B, C, and D. In other embodiments of the invention, the discharge of integrator 14 can be obtained by a voltage other than "−a" volts. However, although it is possible to use any discharging voltage as long as it is constant, the use of "−a" volts simplifies the apparatus in two regards: (1) a pair of reference voltage sources are not required to supply the discharge voltage for the two possible polarities of the output voltage of integrator 14; and (2) only 4 measurements (to determine offset /a, B. C and D) need be performed instead of 5 measurements (to determine offset, a, b, c and d) if a reference voltage is used for discharging integrator 14. (Note that this discharge step is also known as rundown).

The invention should not be limited to the combination of elements shown in the embodiment of FIG. 1. The combination of circuit element 6, 8, and 10 essentially function as a synchronous rectifier. The use of wave shaper 10 in the input path of signal 30 enables the use of an inexpensive modulator as element 6 since modulation need be performed only at the two voltage levels of signal 30. Wave shaper 10 can be omitted if a more expensive modulator is employed which accurately multiplies the instantaneous values of two input signals. Also, in the embodiment of FIG. 1, integrator 14, comparator 16 and counter 18 function as a dual-slope voltmeter but it is clear that the method of this invention does not depend on the type of the voltmeter employed. Any type of voltmeter which can measure the in-phase component voltage and the orthogonal component of the first input signal E1 relative to the second input signal E2 can be used.

As the above discussion illustrates, this invention provides an apparatus for the precise measurement of the vector voltage ratio between two input a.c. signals since it removes the effect of the phase errors in the synchronous detecting circuit, without the need for complicated analog circuitry.

Typically $\theta_1$ is small and positive so that the components a and b of input signal E1 are both positive, but the components c and d of input signal E2 can be positive or negative. In order to handle the possibility of negative components, the rundown phase (i.e. Step (4)) of Steps (I)-(IV) includes a step of sensing the polarity of the output voltage of integrator 14. If the polarity is positive as in the illustration of FIG. 4, the amount of phase shift is selected to be $\pi$ so that the discharging voltage is "−a". If the polarity is negative, the amount of phase shift is selected to be 0 so that the discharging voltage is +a.

We claim:

1. An apparatus for measuring the vector voltage ratio of two a.c. signals, said apparatus comprising:

input means selectively coupled either to a first input terminal to enter a first input signal or to a second input terminal to enter a second input signal;

a phase shifter coupled to the first input terminal;

a synchronous rectifying circuit coupled to the phase shifter and to the first input terminal to provide a rectified signal;

a voltmeter coupled to the synchronous rectifying circuit to measure the d.c. component of the rectified signal;

calculating means coupled to the voltmeter for determining the vector voltage ratio of the second input signal to the first input signal; and control means coupled to the phase shifter, to the input means and to the voltmeter for regulating the steps involved in the determination of the vector voltage ratio.

2. An apparatus as recited in claim 1 further comprising a ground input terminal selectively coupled to the input means to enable correction of voltmeter offset error.

3. An apparatus as recited in claim 1 wherein said voltmeter is a dual-slope voltmeter.

4. An apparatus as recited in claim 1 or claim 2 wherein the voltmeter measures the d.c. component of the rectified signal by applying the rectified signal to the input of an integrator for a constant time Tc to charge the integrator, then applying a discharging voltage of absolute magnitude equal to the absolute magnitude of the in-phase component of the first input signal until the integrator is totally discharged, and calculating the d.c. component of the rectified signal from the values of Tc and the time required to discharge the integrator.

* * * * *